US010310443B1

(12) United States Patent
Nishioka

(10) Patent No.: US 10,310,443 B1
(45) Date of Patent: Jun. 4, 2019

(54) IMAGE FORMING APPARATUS

(71) Applicant: KYOCERA Document Solutions Inc., Osaka (JP)

(72) Inventor: Nobuhiro Nishioka, Osaka (JP)

(73) Assignee: KYOCERA DOCUMENT SOLUTIONS, Osaka (JP)

( * ) Notice: Subject to any disclaimer, the term of this patent is extended or adjusted under 35 U.S.C. 154(b) by 0 days.

(21) Appl. No.: 16/196,764

(22) Filed: Nov. 20, 2018

(30) Foreign Application Priority Data

Jan. 17, 2018 (JP) ..... 2018-005350

(51) Int. Cl.
*G03G 21/18* (2006.01)
*G03G 21/16* (2006.01)

(52) U.S. Cl.
CPC ..... *G03G 21/1633* (2013.01); *G03G 21/1638* (2013.01); *G03G 21/1832* (2013.01); *G03G 21/1842* (2013.01); *G03G 2221/1609* (2013.01)

(58) Field of Classification Search
CPC ..... G03G 21/169; G03G 21/1633; G03G 21/1638; G03G 21/1832; G03G 21/1842
USPC ..... 399/107, 110–114, 124
See application file for complete search history.

(56) References Cited

U.S. PATENT DOCUMENTS 5,845,176 A * 12/1998 Yoshida ..... G03G 15/0896 399/113
6,470,159 B2 * 10/2002 Dycher ..... G03G 21/1832 399/114
7,831,173 B2 * 11/2010 Kusukawa ..... G03G 21/1671 399/107

FOREIGN PATENT DOCUMENTS

JP 2005-91482 A 4/2005
JP 2010-210729 A 9/2010

* cited by examiner

*Primary Examiner* — Hoan H Tran
(74) *Attorney, Agent, or Firm* — Stein IP, LLC

(57) ABSTRACT

An image forming apparatus has an openable-closable member, an image carrier, a cover sheet, and a cover moving mechanism. The openable-closable member is arranged in an open position where it keeps a recording medium conveying passage open and in a closed position where it keeps the recording medium conveying passage closed. The cover sheet is reciprocatable between a protection position where it covers the recording medium conveying passage side of the image carrier and a retracted position where it is retracted from the recording medium conveying passage. The cover moving mechanism moves the cover sheet to the retracted position or to the protection position by opening and closing the openable-closable member. Drawing out the cover sheet in the protection position to the recording medium conveying passage side causes the cover sheet to be arranged in a recording medium removal position.

5 Claims, 5 Drawing Sheets

IMAGE FORMING APPARATUS

INCORPORATION BY REFERENCE

This application is based upon and claims the benefit of priority from the corresponding Japanese Patent Application No. 2018-5350 filed on Jan. 17, 2018, the entire contents of which are incorporated herein by reference.

BACKGROUND

The present disclosure relates to image forming apparatuses using an electrophotographic system, such as copiers, printers, facsimile machines, and multifunction peripherals incorporating their functions. More particularly, the present disclosure relates to image forming apparatuses provided with a mechanism for protecting a photosensitive member arranged near an openable-closable member.

Conventional image forming apparatuses using an electrophotographic system, such as printers, copiers, and facsimile machines, transfer a toner image to the surface of a sheet while conveying the sheet to a photosensitive drum. Then, the toner image transferred on the surface of the sheet is fixed to the sheet by a fixing portion. The sheet to which the toner image has now been fixed is discharged to outside the image forming apparatus. A sheet conveying passage leading from the photosensitive drum to the fixing portion can be opened for jam (sheet jam) handling by opening the openable-closable member rotatably supported on an image forming apparatus main body.

Here, when the openable-closable member is opened, the surface of the photosensitive drum is exposed to outside the image forming apparatus, and the photosensitive drum is exposed to external light. As a result, a photosensitive layer formed on the surface of the photosensitive drum may be degraded. Also, if the exposed photosensitive drum is touched by a hand or an object, the surface of the photosensitive drum may be contaminated or scratched.

To avoid that, there is provided a drum cover that moves, in coordination with the openable-closable member, between a position where the drum cover covers the photosensitive drum and a position where the drum cover is retracted from the sheet conveying passage. When the openable-closable member is closed, the drum cover is retracted from the sheet conveying passage, so that a toner image on the surface of the photosensitive drum can be transferred to a sheet. Opening the openable-closable member for jam handling opens the sheet conveying passage as well as causes the drum cover to cover the surface of the photosensitive drum on the side facing away from the image forming apparatus main body to prevent the surface of the photosensitive drum from being exposed to outside the apparatus.

There is provided a cooling portion for preventing an image forming unit including the photosensitive drum and a developing device from being exposed to high temperature due to heat from the fixing device. When the drum cover for protecting the surface of the photosensitive drum is retracted, the drum cover is positioned in the air flow generated by the cooling portion.

SUMMARY

According to one aspect of the present disclosure, an image forming apparatus has an openable-closable member, an image carrier, a cover sheet, and a cover moving mechanism. The openable-closable member is arranged in an open position where it keeps a recording medium conveying passage open and in a closed position where it keeps the recording medium conveying passage closed. A part of the outer circumferential face of the image carrier is exposed to outside when the recording medium conveying passage is open. The cover sheet is flexible and is reciprocatable between a protection position in which the cover sheet covers a recording medium conveying passage side of the image carrier and a retracted position in which the cover sheet is retracted from the recording medium conveying passage. The cover moving mechanism, as the openable-closable member moves to the closed position, moves the cover sheet to the retracted position and, as the openable-closable member moves to the open position, moves the cover sheet to the protection position. Drawing out the cover sheet arranged in the protection position to the recording medium conveying passage side causes the cover sheet to be arranged in a recording medium removal position where the interval between the image carrier and the cover sheet is larger than that in the protection position.

This and other objects of the present disclosure, and the specific benefits obtained according to the present disclosure, will become apparent from the description of embodiments which follows.

DETAILED DESCRIPTION

Figure 1:
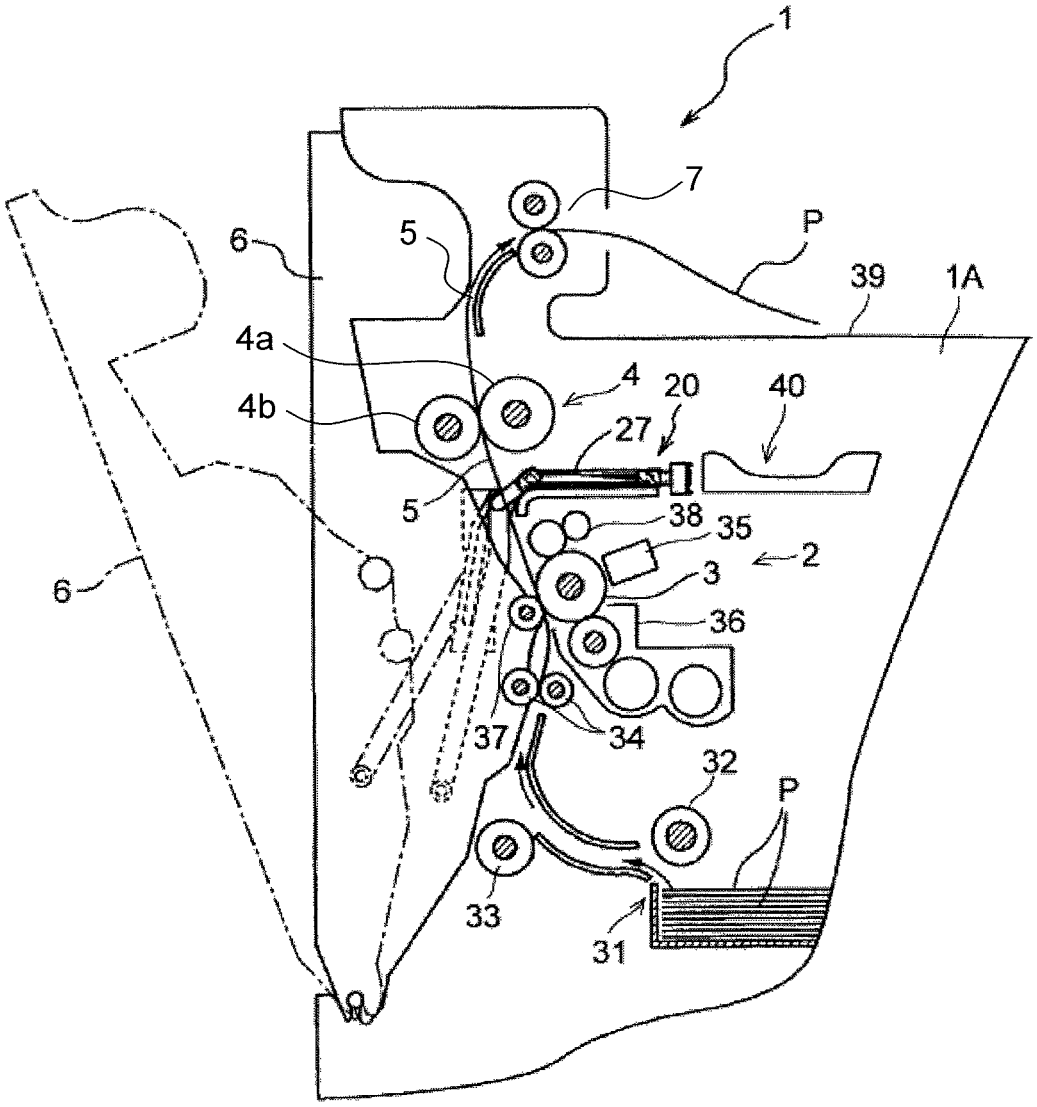
FIG. 1 is a cross-sectional side view showing a main part of an image forming apparatus according to one embodiment of the present disclosure.

With reference to the accompanying drawings, embodiments of the present disclosure will be described below. FIG. 1 is a cross-sectional side view showing a main part of an image forming apparatus 1 according to one embodiment of the present disclosure. The image forming apparatus 1 is a monochrome printer, and is provided with a sheet feeding portion 31 arranged at a lower part of an apparatus main body 1A, a sheet conveying passage 5 for conveying a sheet P upward from the sheet feeding portion 31, an image forming portion 2 arranged to the right of the sheet conveying passage 5, a fixing device 4 arranged above the image forming portion 2, a cover moving mechanism 20 arranged around a photosensitive drum 3 in the image forming portion 2, and a cooling portion 40 arranged to the right of the cover moving mechanism 20. The cooling portion 40 cools down an image forming unit, including the photosensitive drum 3, a developing device 36, and a cleaning unit 38, to which the heat radiated from the fixing device 4 is transmitted as well as a sheet P conveyed through the sheet conveying passage 5 via the fixing device 4.

The sheet feeding portion 31 picks up the sheets P stored in a sheet feeding cassette with a pick-up roller 32 one sheet after another and conveys them to the sheet conveying passage 5. The sheet conveying passage 5 has a conveying roller 33 and a registration roller pair 34, and conveys the sheet P sent out from the sheet feeding portion 31 toward the image forming portion 2.

The image forming portion 2 forms a predetermined toner image on a sheet P by an electrophotographic method. The image forming portion 2 includes the photosensitive drum 3 which is pivoted so as to be rotatable in the clockwise direction in FIG. 1. Around the photosensitive drum 3, there are arranged a charger 35, the developing device 36, a transfer roller 37, the cleaning unit 38, and the like along the rotating direction of the photosensitive drum 3.

The charger 35 is provided with a charging wire to which a high voltage is applied, and by corona discharge from the charging wire, the surface of the photosensitive drum 3 is electrostatically charged uniformly. For the photosensitive drum 3, an amorphous silicon photosensitive member having an amorphous silicon photosensitive layer as a photosensitive layer or an organic photosensitive member (OPC photosensitive member) with an organic photosensitive layer as a photosensitive layer is used. When the photosensitive drum 3 is irradiated with a laser beam from an exposure unit (unillustrated) based on image data transmitted from a host device such as a personal computer, the surface potential of the photosensitive drum 3 is selectively attenuated to form an electrostatic latent image on the surface of the photosensitive drum 3.

Then, the developing device 36 develops the electrostatic latent image on the surface of the photosensitive drum 3 to form a toner image on the surface of the photosensitive drum 3. The toner image formed on the surface of the photosensitive drum 3 is transferred to a sheet P by the transfer roller 37. The toner remaining on the surface of the photosensitive drum 3 after the transfer is removed by the cleaning unit 38. Residual electric charges on the surface of the photosensitive drum 3 are removed by a static eliminator (unillustrated) in preparation for the next image formation.

The sheet P to which the toner image has been transferred is conveyed to the fixing device 4 arranged on the downstream side of the sheet conveying passage 5. In the fixing device 4, as the sheet P passes through the nip portion (fixing nip portion) between a fixing roller 4*a* and a pressing roller 4*b*, it is heated and pressed and thereby the toner image is fixed to the sheet P. The sheet P on which the toner image is fixed is discharged onto a discharge tray 39 by a discharge roller pair 7. The sheet conveying passage 5 leading from the sheet feeding portion 31 to the discharge roller pair 7 is in a left part of the apparatus main body 1A and extends substantially in the up-down direction.

On the left wall of the apparatus main body 1A, an access cover 6 (openable-closable member) is provided. The access cover 6 can be opened and closed with respect to the apparatus main body 1A for jam handling in the sheet conveying passage 5. When the access cover 6 is opened, a conveying face that forms the sheet conveying passage 5 is split between the apparatus main body 1A side and the access cover 6 side, and thus the sheet P left in the sheet conveying passage 5 can be removed.

A lower end part of the access cover 6 is rotatably pivoted on the apparatus main body 1A. By being operated to swing about a pivot, the access cover 6 can be switched between an open state (the state indicated by a dash-dot-line in FIG. 1) in which an opening is formed between the apparatus main body 1A and the access cover 6 and a closed state (the state indicated by a solid-line in FIG. 1) in which the inside of the apparatus main body 1A is sealed from outside. When the access cover 6 is in the closed state, it is possible to perform image formation; when the access cover 6 is in the open state, a cover sheet 27 moves from above the photosensitive drum 3 to the left by the action of the cover moving mechanism 20, which will be described later. With this, when the access cover 6 is opened for jam handling, it is possible to prevent the surface of the photosensitive drum 3 from being scratched through contact with an operator's hand or a tool, and to prevent the photosensitive layer from degrading due to external disturbance light striking the photosensitive drum 3.

Figure 2:
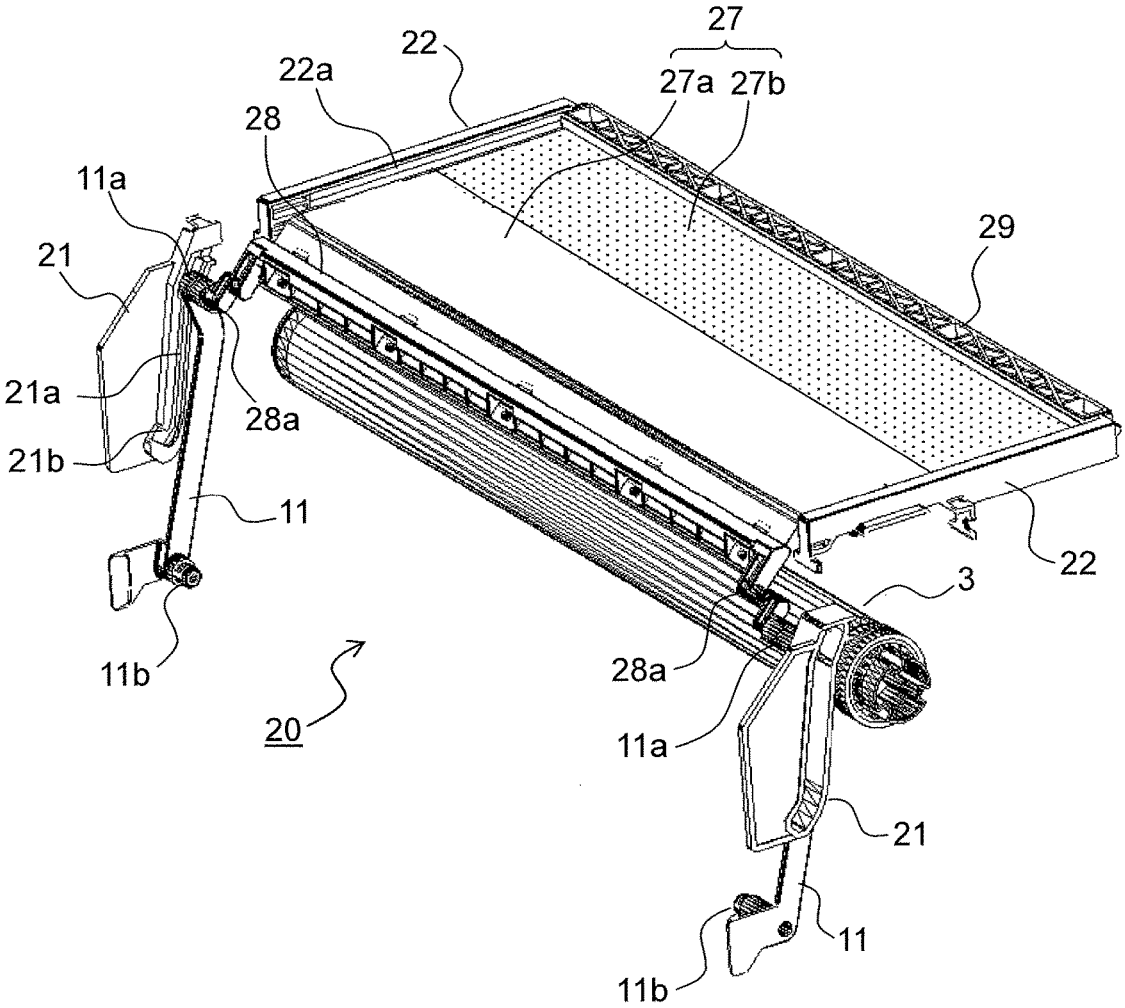
FIG. 2 is a perspective view showing a cover moving mechanism in the image forming apparatus of the embodiment when an access cover is closed.
Figure 3:
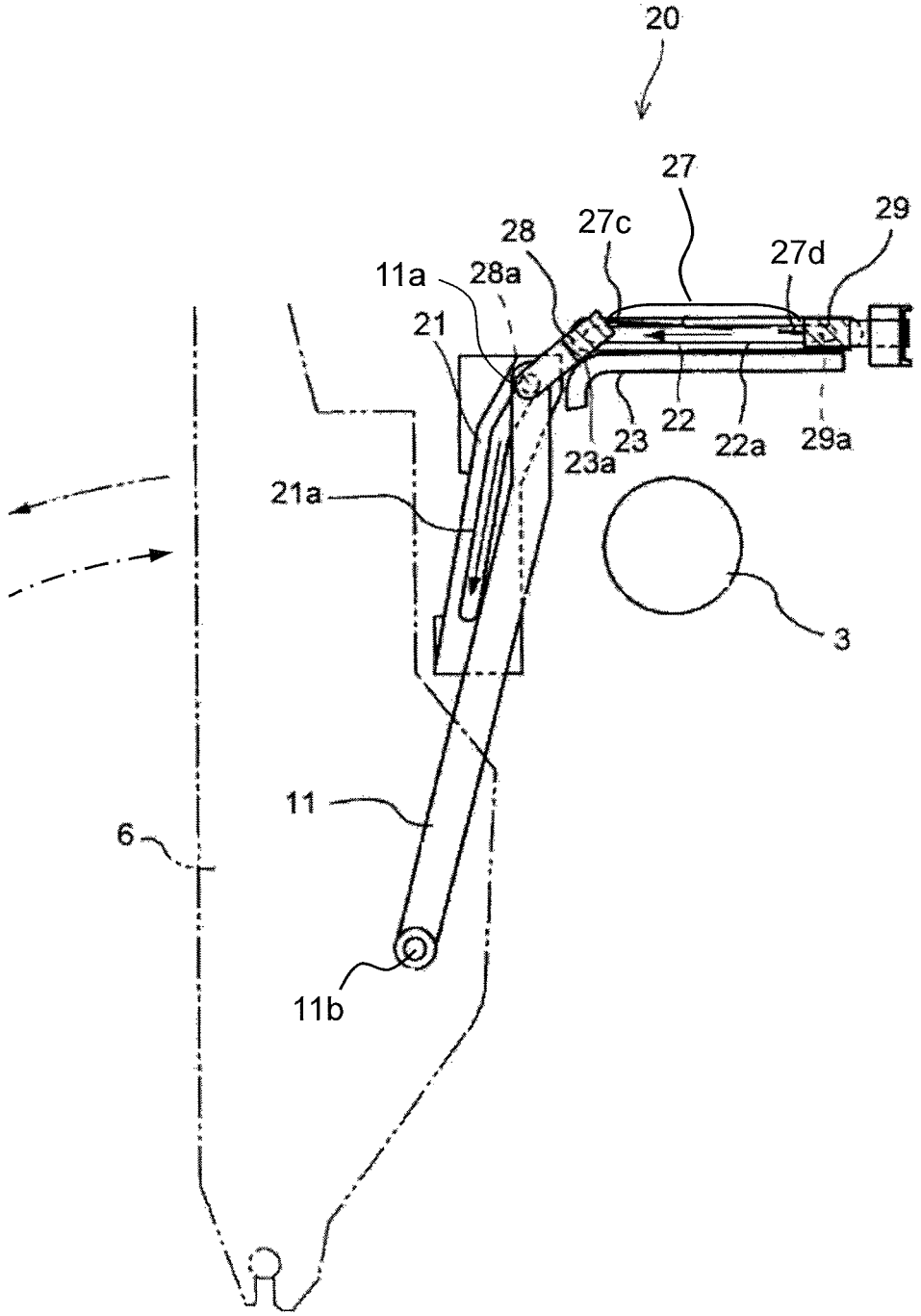
FIG. 3 is a cross-sectional side view showing the cover moving mechanism in the image forming apparatus of the embodiment when the access cover is closed.

FIG. 2 is a perspective view showing the cover moving mechanism 20 when the access cover 6 is in the closed state (during image formation). FIG. 3 is a cross-sectional side view showing the cover moving mechanism 20 when the access cover 6 is in the closed state. With reference to FIGS. 2 and 3, the cover moving mechanism 20 that moves the cover sheet 27 will be described in detail.

As shown in FIG. 2, the cover moving mechanism 20 is provided with a link arm 11, an arm rail 21, a holder rail 22, a sheet guide 23 (see FIG. 3), and the cover sheet 27, as well as a first sheet holder 28 and a second sheet holder 29 which support the cover sheet 27.

The cover sheet 27 is a flexible sheet material formed of high molecular weight polyethylene, and its obverse side (the side opposite to the photosensitive drum 3) is coated with a heat reflective film to have heat insulating properties. The length of the cover sheet 27 in the width direction (in the axial direction of the photosensitive drum 3) is set to be equal to or longer than the length of the photosensitive drum 3 in the axial direction. The length of the cover sheet 27 in the moving direction (in the left-right direction in FIG. 2 and in the up-down direction in FIG. 3) is set to be approximately twice as large as the outer diameter of the photosensitive drum 3. When the access cover 6 (see FIG. 1) is in the closed position, the cover sheet 27 is arranged above the photosensitive drum 3. The cover sheet 27 has an opaque light shielding portion 27*a* located on the first sheet holder 28 side and a transparent or translucent light transmitting portion 27*b* (the hatched part in FIG. 2) located on the second sheet holder 29 side.

The first sheet holder 28 fixedly supports the front edge portion 27*c* of the cover sheet 27 generally over its full width. The second sheet holder 29 fixedly supports the rear edge portion 27*d* of the cover sheet 27 generally over its full width. At the opposite ends of the first sheet holder 28 in the longitudinal direction, there is formed a pair of first engaging bosses 28*a*. At the opposite ends of the second sheet holder 29 in the longitudinal direction, there is formed a pair of second engaging bosses 29*a*.

In the apparatus main body 1A, a pair of arm rails 21 and a pair of holder rails 22 are fixedly arranged in the width direction. On the arm rail 21, there is formed a vertical rail groove 21*a* that extends substantially in the up-down direction. On the holder rail 22, there is formed a horizontal rail groove 22*a* that extends substantially in the horizontal direction.

The first engaging bosses 28*a* formed at the opposite ends of the first sheet holder 28 are swingably coupled to a swing shaft 11*a* formed in an upper end part of a pair of link arms 11. The swing shaft 11*a* is slidably engaged with the vertical rail groove 21*a* formed on the arm rail 21. In a lower end part of the vertical rail groove 21*a*, there is formed a guide groove 21*b* that leads to the vertical rail groove 21*a*. The swing shaft 11*a* can be attached to and detached from the vertical rail groove 21*a* via the guide groove 21*b*.

The link arm 11 is swingably supported, by a swing pivot 11*b* formed at its lower end part, on the access cover 6. The first sheet holder 28 is movable in coordination with the access cover 6 via the link arm 11.

The second engaging bosses 29*a* formed at the opposite ends of the second sheet holder 29 slidably engage with the horizontal rail grooves 22*a* formed in the pair of holder rails 22.

A sheet guide 23 is arranged between the pair of holder rails 22. The sheet guide 23 extends in a horizontal direction along the horizontal rail groove 22*a* so as to face the bottom face of the cover sheet 27 and, at the left end (on the arm rail 21 side) of the sheet guide 23, an arc-shaped curved portion 23*a* is formed. When the first sheet holder 28 moves in the up-down direction and the second sheet holder 29 moves in the horizontal direction, the cover sheet 27 supported by the first sheet holder 28 and the second sheet holder 29 is guided to the curved portion 23*a* of the sheet guide 23 and moves along an arc-shaped orbit around the photosensitive drum 3.

Figure 4:
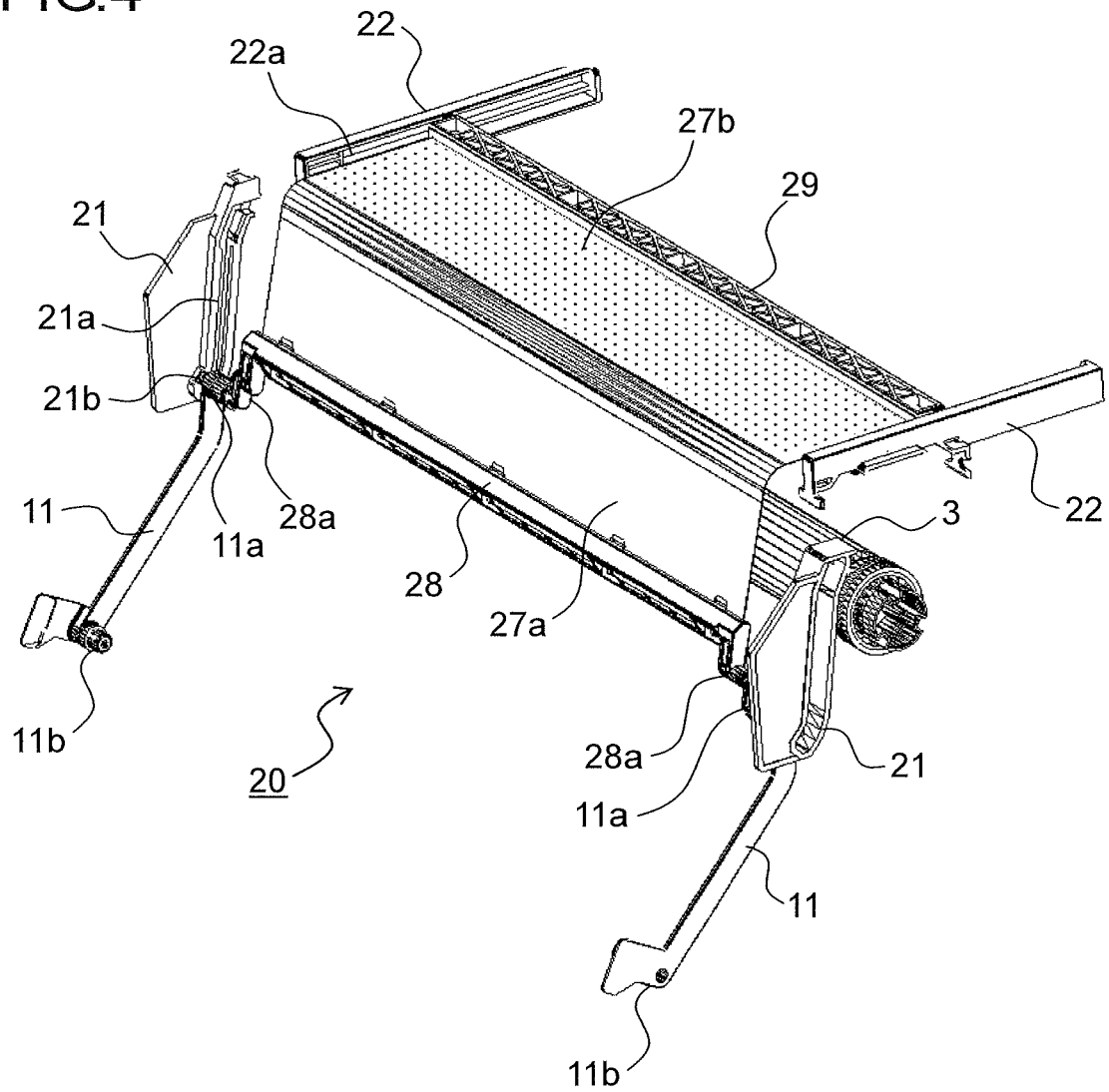
FIG. 4 is a perspective view showing the cover moving mechanism in the image forming apparatus of the embodiment when the access cover is open.

FIG. 4 is a perspective view showing the cover moving mechanism 20 when the access cover 6 is in the open state. With reference to FIGS. 2, 3, and 4, operation by the cover moving mechanism 20 for moving the cover sheet 27 will be described in detail.

When the access cover 6 is in the closed state, as shown in FIGS. 2 and 3, the cover sheet 27 is arranged in a position (hereinafter, called a retracted position) retracted from the sheet conveying passage 5 to above the photosensitive drum 3 and under the fixing device 4 (see FIG. 1). The length of the cover sheet 27 in the movement direction (the left-right direction in FIG. 3) is larger than the length from an upper end part of the vertical rail groove 21*a* (the position of the first sheet holder 28 in the retracted position) to a right end part of the horizontal rail groove 22*a* (the position of the second sheet holder 29 in the retracted position), and thus the cover sheet 27 is in a bent state in the retracted position. The sheet guide 23 is under the cover sheet 27, and thus, as shown in FIG. 3, the cover sheet 27 is bent upward.

When the access cover 6 is pivoted in the opening direction as indicated by a dash-dot-dot-line arrow in FIG. 3 from the state where the access cover 6 is closed, the link arm 11 moves in coordination with the access cover 6, and the swing shaft 11*a* moves from the upper end part of the vertical rail groove 21*a* in the direction indicated by a solid-line arrow in FIG. 3. Accordingly, also the first sheet holder 28 coupled to the swing shaft 11*a* of the link arm 11 moves downward along the vertical rail groove 21*a*.

As the first sheet holder 28 moves, via the cover sheet 27, also the second sheet holder 29 moves from the right end part of the horizontal rail groove 22*a* to the left side in the direction indicated by the sold line arrow in FIG. 3. With this, the cover sheet 27 is guided along the sheet guide 23 while straightening from the bent state and, in the curved portion 23*a*, moves in an arc shape around the photosensitive drum 3. Then, when the access cover 6 moves to an open position, as shown in FIG. 4, the second sheet holder 29 moves to around the middle of the horizontal rail groove 22*a* in the longitudinal direction, and the cover sheet 27 moves from the retracted position as shown in FIG. 3 to such a position (hereinafter, called a protection position) as to cover the sheet conveying passage 5 side (the left, near side in FIG. 4) and the fixing device 4 side (the upper side in FIG. 4) of the photosensitive drum 3.

In the protection position, the light shielding portion 27*a* of the cover sheet 27 is positioned at the sheet conveying passage 5 side of the photosensitive drum 3, so that, by shielding the external disturbance light toward the photosensitive drum 3 when the access cover 6 is open, the light shielding portion 27*a* prevents degradation of the photosensitive layer of the photosensitive drum 3; it also prevents the surface of the photosensitive drum 3 from being scratched through contact with an operator's hand or a tool.

When the access cover 6 in the open state is pivoted in the closing direction as indicated by a dash-dot-line arrow in FIG. 3, the link arm 11 moves in coordination with the access cover 6, and the swing shaft 11*a* moves upward from the lower end part of the vertical rail groove 21*a*. Accordingly, the first sheet holder 28 coupled with the swing shaft 11*a* of the link arm 11 also moves upward along the vertical rail groove 21*a*. Also, as the first sheet holder 28 moves upward, a force in the compressing direction acts on the cover sheet 27 between the first sheet holder 28 and the second sheet holder 29.

As a result, with a restoring force (elastic force) of the cover sheet 27, the second sheet holder 29 is pressed to move to the right in FIG. 4 along the horizontal rail groove 22*a*. Then, the cover sheet 27 is, until the second sheet holder 29 reaches the right end part of the horizontal rail groove 22*a*, guided in a straightened state along the sheet guide 23 and, in the curved portion 23*a*, the cover sheet 27 moves in an arc shape around the photosensitive drum 3.

After the second sheet holder 29 reaches the right end part of the horizontal rail groove 22*a* and stops, the link arm 11 continues to pivot and the swing shaft 11*a* moves toward the upper end part of the vertical rail groove 21*a*. As a result, the distance between the first sheet holder 28 and the second sheet holder 29 becomes smaller than the length of the cover sheet 27 in the moving direction, and thus the cover sheet 27 bends from the straightened state, while moving to above the photosensitive drum 3 to return to the retracted position as shown in FIGS. 2 and 3.

Here, when the access cover 6 is moved into the open position to remove a jammed sheet P in the sheet conveying passage 5, if the sheet P is left in front of the cover sheet 27, the sheet P can be easily removed; however, if the sheet P is left between the cover sheet 27 and the photosensitive drum 3, it is difficult to recognize the sheet P visually due to the cover sheet 27 and the sheet P may be forgotten to be removed. To avoid this, in this embodiment, the cover sheet 27 can be moved to a position (hereinafter, called a sheet removal position) where the cover sheet 27 is drawn further out to the access cover 6 side from the protection position shown in FIG. 4.

Figure 5:
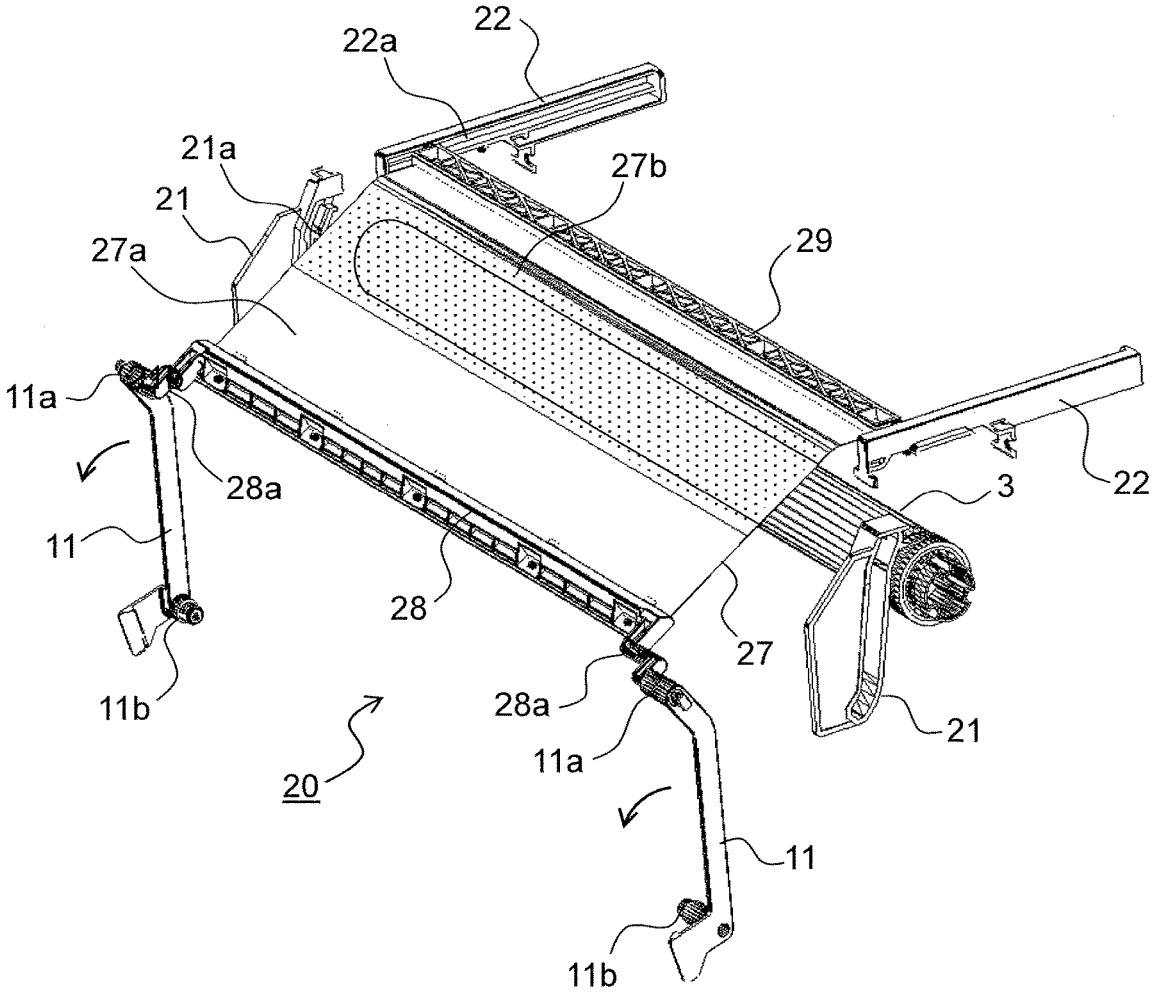
FIG. 5 is a perspective view showing the cover moving mechanism in the image forming apparatus of the embodiment when the cover sheet is arranged in a sheet removal position.

FIG. 5 is a perspective view showing a state where the cover sheet 27 is moved to the sheet removal position from the state in FIG. 4. With reference to FIGS. 2 to 4 and 5, operation by the cover moving mechanism 20 for moving the cover sheet 27 to the sheet removal position will be described.

When a sheet P has been jammed between the cover sheet 27 and the photosensitive drum 3, from a state in FIG. 4 where the cover sheet 27 is arranged in the protection position, the swing shaft 11*a* of the link arm 11 is removed from the vertical rail groove 21*a* via the guide groove 21*b*. Then, the link arm 11 is pivoted about the swing pivot 11*b* as the center in the counter-clockwise direction in FIG. 4.

With this, the first sheet holder 28 coupled with the swing shaft 11*a* in an upper end part of the link arm 11 pivots together with the link arm 11 to move to the left, near side in FIG. 4. As a result, the cover sheet 27 is, together with the first sheet holder 28, drawn out to the sheet conveying passage 5 side (the left, near side in FIG. 4) to be arranged in the sheet removal position shown in FIG. 5. In the sheet removal position, the interval between the cover sheet 27 and the photosensitive drum 3 is larger than that in the protection position.

According to this embodiment, the cover sheet 27 can be arranged in one of the three positions, namely, the retracted position, the protection position, and the sheet removal position. If a sheet P is jammed between the cover sheet 27 and the photosensitive drum 3, the cover sheet 27 is arranged in the sheet removal position where the interval between the cover sheet 27 and the photosensitive drum 3 is large. This permits easy removal of a sheet P left between the cover sheet 27 and the photosensitive drum 3, and brings improved jam handling workability.

Also, the light transmitting portion 27*b* of the cover sheet 27 arranged above the photosensitive drum 3 in the protection position is drawn out to the sheet conveying passage 5 side of the photosensitive drum 3. With this, the presence or the absence of a sheet P left between the cover sheet 27 and the photosensitive drum 3 can be recognized visually through the light transmitting portion 27*b*, and a failure to remove a sheet P can be prevented.

When jam handling is finished, the swing shaft 11*a* of the link arm 11 is engaged with the vertical rail groove 21*a* via the guide groove 21*b*. Then, when the link arm 11 is pivoted about the swing pivot 11*b* as the center in the clockwise direction in FIG. 5, the cover sheet 27 is arranged back in the protection position shown in FIG. 4.

In the sheet removal position where the light transmitting portion 27*b* is drawn out to the sheet conveying passage 5 side of the photosensitive drum 3, the photosensitive drum 3 is irradiated with external disturbance light via the light transmitting portion 27*b*. However, after jam handling is finished, if the cover sheet 27 is promptly returned to the protection position according to the procedure described above, the time for which the photosensitive drum 3 is irradiated with external disturbance light can be minimized, and thus there is no risk that the photosensitive layer of the photosensitive drum 3 is degraded.

The embodiment described above is in no way meant to limit the present disclosure, which thus allows for many modifications and variations within the spirit of the present disclosure. For example, in the above embodiment, when the cover sheet 27 is moved from the protection position to the retracted position, with the restoring force (elastic force) of the cover sheet 27, the second sheet holder 29 is pressed to move to the right in FIG. 4 along the horizontal rail groove 22*a*. Instead of this structure, it is also possible to fit a biasing member such as a coil spring to the second sheet holder 29 on the side opposite to the cover sheet 27 so that the second sheet holder 29 moves to the right in FIG. 4 by the biasing force of the biasing member.

The present disclosure is applicable not only to monochrome printers like the one shown in FIG. 1 but also to various types of image forming apparatuses provided with a drum cover for protecting the photosensitive drum, such as color printers, monochrome and color copiers, and facsimile machines.

The present disclosure is applicable to image forming apparatuses using an electrophotographic system such as copiers, printers, facsimile machines, and multifunction peripherals incorporating their functions. Based on the present disclosure, it is possible to provide an image forming apparatus which prevents degradation of and damage to an image carrier by means of a cover for protecting the image carrier and which offers improved jam handling operability.

What is claimed is:

1. An image forming apparatus comprising:

an openable-closable member which is arranged in an open position in which the openable-closable member keeps a recording medium conveying passage open and in a closed position in which the openable-closable member keeps the recording medium conveying passage closed;

an image carrier of which part on an outer circumferential face thereof is exposed to outside when the recording medium conveying passage is open;

a cover sheet which is flexible and which is reciprocatable between a protection position in which the cover sheet covers a recording medium conveying passage side of the image carrier and a retracted position in which the cover sheet is retracted from the recording medium conveying passage; and a cover moving mechanism which moves the cover sheet to the retracted position as the openable-closable member moves to the closed position and which moves the cover sheet to the protection position as the openable-closable member moves to the open position, wherein drawing out the cover sheet arranged in the protection position to the recording medium conveying passage side causes the cover sheet to be moved to a recording medium removal position in which the cover sheet has a larger interval from the image carrier than in the protection position.

2. The image forming apparatus according to claim 1, wherein the cover sheet has a light shielding portion and a light transmitting portion that is transparent or translucent, and when the cover sheet is arranged in the recording medium removal position, the light transmitting portion covers the recording medium conveying passage side of the image carrier.

3. The image forming apparatus according to claim 1, wherein the cover moving mechanism includes a first sheet holder which holds one end of the cover sheet in a moving direction, a second sheet holder which holds another end of the cover sheet in the moving direction, a pair of link arms having a swing shaft with which one end part of the first sheet holder is pivotably coupled and a swing pivot which is pivotably supported by the openable-closable member, a pair of arm rails which slidably supports the swing shaft of the link arms, and a pair of holder rails which slidably supports opposite end parts of the second sheet holder, wherein in a state where the cover sheet is arranged in the protection position, removing the swing shaft of the link arms from the arm rails and pivoting the link arms about the swing pivot as a center to the openable-closable member side causes the cover sheet to be arranged in the recording medium removal position.

4. The image forming apparatus according to claim 3, wherein the arm rails have a vertical rail groove along which the swing shaft slides when the cover sheet reciprocates between the retracted position and the protection position, and a guide groove for attaching the swing shaft to and removing the swing shaft from the vertical rail groove when the cover sheet is moved from the protection position to the recording medium removal position and when the cover sheet is moved from the recording medium removal position to the protection position.

5. The image forming apparatus according to claim 3, wherein a sheet guide which extends along the holder rails in a horizontal direction and faces a bottom face of the cover sheet is arranged between the pair of holder rails, and an arc-shaped curved portion surrounding the image carrier is formed in an end part, on an arm rail side, of the sheet guide.

* * * * *